US006428402B1

(12) United States Patent
Momosaki

(10) Patent No.: US 6,428,402 B1
(45) Date of Patent: Aug. 6, 2002

(54) GLASS MACHINING APPARATUS

(75) Inventor: Mitsukazu Momosaki, Fukuoka (JP)

(73) Assignee: Alpha Professional Tools, Wyckoff, NJ (US)

( * ) Notice: Subject to any disclaimer, the term of this patent is extended or adjusted under 35 U.S.C. 154(b) by 0 days.

(21) Appl. No.: 09/948,129

(22) Filed: Sep. 6, 2001

(51) Int. Cl.[7] ..... B24B 7/00
(52) U.S. Cl. ..... 451/178; 451/231; 451/412
(58) Field of Search ..... 451/41, 178, 231, 451/257, 412, 358, 359; 83/875, 879, 881, 745, 471.2, 477.1

(56) References Cited

U.S. PATENT DOCUMENTS

| | | | | | |
|---|---|---|---|---|---|
| 8,323 | A | * | 8/1851 | Colne | 451/41 |
| 1,502,990 | A | * | 7/1924 | Kiefer | 451/247 |
| 1,979,140 | A | * | 10/1934 | Casey | 451/231 |
| 2,371,401 | A | * | 3/1945 | Martin | 451/358 |
| 3,205,621 | A | * | 9/1965 | Davis et al. | 451/231 |
| 3,421,265 | A | * | 1/1969 | Parachek | 451/231 |
| 3,457,809 | A | * | 7/1969 | Bowerman | 76/40 |
| 4,136,489 | A | * | 1/1979 | von Allmen | 451/231 |
| 4,376,356 | A | * | 3/1983 | Everett | 451/231 |
| 5,628,677 | A | * | 5/1997 | Hermann | 451/231 |

* cited by examiner

*Primary Examiner*—Joseph J. Hail, III
*Assistant Examiner*—David B. Thomas
(74) *Attorney, Agent, or Firm*—Weingram & Associates, P.C.

(57) ABSTRACT

A glass machining apparatus is provided to machine large-scale glass sheets. The apparatus includes a base plate with an operating use hole, a functional section support with a base end section that pivots on the base plate, a glass machining disk at the front end section of the functional support section, and a drive motor on the functional section support that drives the glass machining disk. The functional section support moves up and down about a pivot support in the center of the base end section and can be variably positioned in any of a non-operating position spaced above the base plate, a first operating position that is adjacent the upper surface of the base plate, and a second operating position that passes below the base plate through the operating use hole.

7 Claims, 10 Drawing Sheets

GLASS MACHINING APPARATUS

BACKGROUND OF THE INVENTION

1. Field of the Invention

This invention relates to glass machining apparatus.

2. Description of the Prior Art

Previously, as one form of a glass machining apparatus, a base end section of a functional section support pivoted on a base stand. A glass machining disk was attached to a front end section of the functional section support, and the glass machining disk could be rotated by a driving motor.

Further, as the functional section support moved freely up and down at the center about a pivot section of a base end section, the position varied freely between the non-operating position with the lower end section of the glass machining disk to the upper position.

The base plate and the operating position was near the upper surface of the base stand.

Thus, a disk form whetstone was attached to the functional section support as a glass machining disk when there was window glass with a finger hold section or handle indentation formed for opening and closing for a glass sheet. This was done by cutting out one sheet which is placed on the base stand by lowering the disk shaped whetstone to the operating position while it is rotating. However, positioning the glass sheet directly below the disk shaped whetstone for formation of the opening and closing finger hold section was difficult and there were complexities in raising and lowering the machine on the base stand when the glass sheet was of a large form while machining operations had to be performed with the glass sheet placed on the base stand for the glass machining apparatus.

OBJECTS AND SUMMARY OF THE INVENTION

Thus, this invention provides a glass machining apparatus with a base plate that has an operating use hole or opening, a functional section support with the base end section pivoting on the same base plate, a glass machining disk that is attached to the front end section of the functional section support, and a drive motor that is positioned on the functional section support driving the glass machining disk. The functional section support moves up and down in the center about a pivot support of the base end section and the position of the lower end section of the glass machining disk is variable in any non-operating position with spacing above the base plate, a first operating position that is near the upper surface of the base plate and a second operating position that is dropped below the base plate through an operating use hole that is formed on the base plate.

Further, this invention may have the following constructions:

1. A drop control device for controlling the dropping portion of the lower end section of a glass machining disk on a functional section support.
2. A non-operating position maintaining device that maintains the lower end section of a glass machining disk between the base plate and the functional section support.
3. A handle for use in carrying is disposed on the functional support.
4. A base plate fixing device is positioned on the base plate for fixing the same base plate on a work stand or a glass sheet.
5. The entire apparatus is movable on rolling wheels attached to one side end section of the base plate. The rolling wheels are able to contact the glass sheet by raising the other side end section of the base plate while the rolling wheels are on the glass sheet.

The glass machining apparatus pertaining to this invention is equipped with a base plate having an operating hole or opening, a functional section support which pivots at the center of the base end section of the base plate, a glass machining disk that is attached to the front end section of the functional section support, and a drive motor that is positioned on the functional section support to drive the glass machining disk. The functional section support moves up and down in the center about a pivot support on the base end section, and the position of the lower end section of the glass machining disk is variable from a non-operating position that is spaced above the base plate. A first operating position is near the upper surface of the base plate, and a second operating position is disposed below the base plate through an opening that is formed in the base plate. Thus, the glass sheet is placed on the base plate when machining small-scale glass sheets and glass sheets can be machined by the lower end of the glass machining disk which pivots as a result of the upper end section of the glass machining disk lowering from the non-operating position to the first operating position while the glass machining disk rotates.

Further, the glass machining apparatus is positioned on the glass sheet that is machined when machining a large-scale glass sheet. The glass sheet is machined by the lower end section of the glass machining disk which pivots as a result of the lower end section of the glass machining disk lowering from a non-operating position to the second operating position through the operating use opening while the glass machining disk rotates.

Thus, the large-scale glass sheet does not move and the machining position matching can be smoothly and accurately performed by moving the glass machining apparatus itself.

The machining depth can be suitably controlled by adjusting the drop position of the lower end section of the glass machining disk utilizing a drop control device disposed on the functional section support.

Safety can be achieved by maintaining the lower end section of the glass machining disk in a non-operating position. A non-operating position maintaining device is employed to maintain the lower section of the glass machining disk in a non-operating position between the base plate and the functional section support.

Further, the glass machining operations can be performed by releasing the non-operating position maintaining device when glass machining operations are performed.

The glass machining apparatus employs a carrying handle to make carrying easier as well as make it easier to raise and lower the apparatus onto large scale glass sheets as a result of the handle being disposed on the functional section support.

Thus, the glass machining operations are not limited to factory locations and can be easily performed at various job sites as well.

A base plate fixing device secures the base plate to a glass sheet along with the glass machining apparatus when a large-scale glass sheet is machined. The base plate fixing device is positioned on the base plate also for securing the base plate on a work stand. The machining of a glass sheet can be accurately performed by raising and lowering of the glass machining disk between a non-operating position and a second operating position.

The glass machining apparatus can be easily moved by using the rolling wheels and by raising the other side end section of the base plate. Since the entire apparatus is movable while the rolling wheels contact and move on the glass plate, the operating efficiency of the glass machining can be improved.

DETAILED DESCRIPTION OF THE INVENTION

Figure 1:
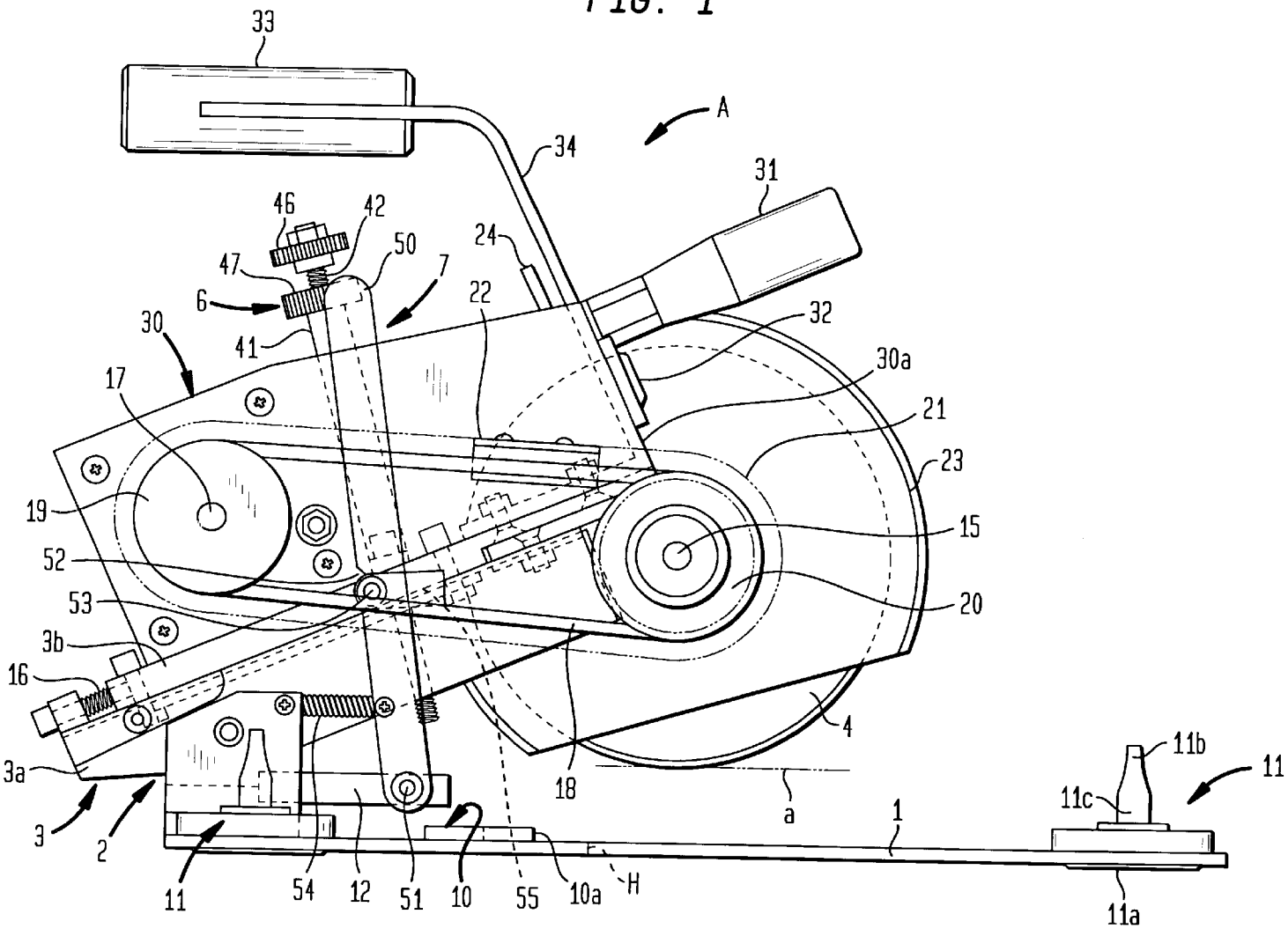
FIG. 1 is a right side view of a glass machining apparatus according to this invention.

As shown in FIGS. 1–5, the glass machining apparatus A is equipped with a base plate 1 with an operating use hole H formed therein, a functional section support 3 on which the base end section pivots about pivot support 2, a glass machining disk 4 that is positioned on the front end section of the support 3, and a drive motor 5 disposed on section support 3 which drives the glass machining disk 4.

Figure 7:
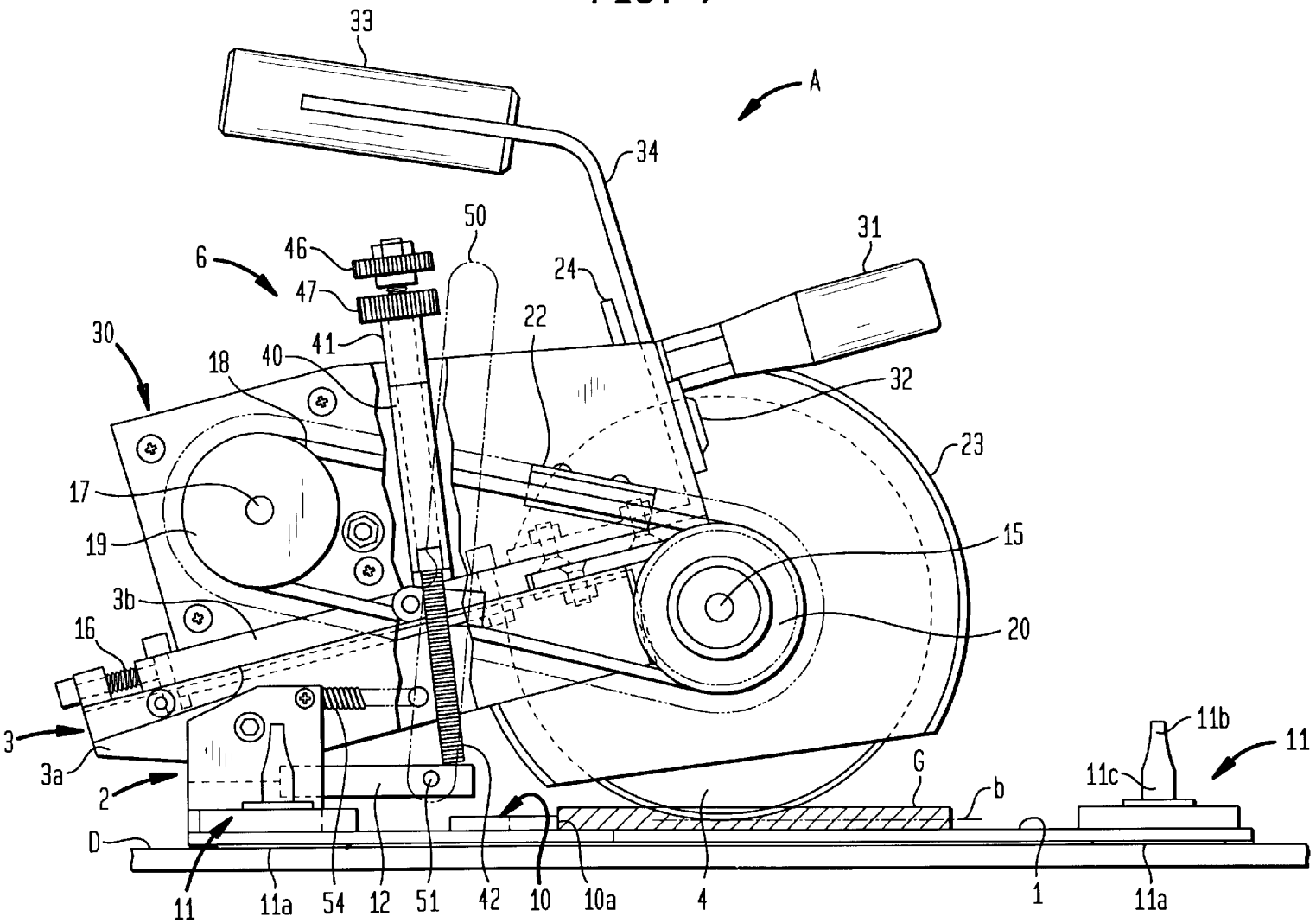
FIG. 7 is a first sectional cut-away lateral view of the glass machining apparatus.
Figure 8:
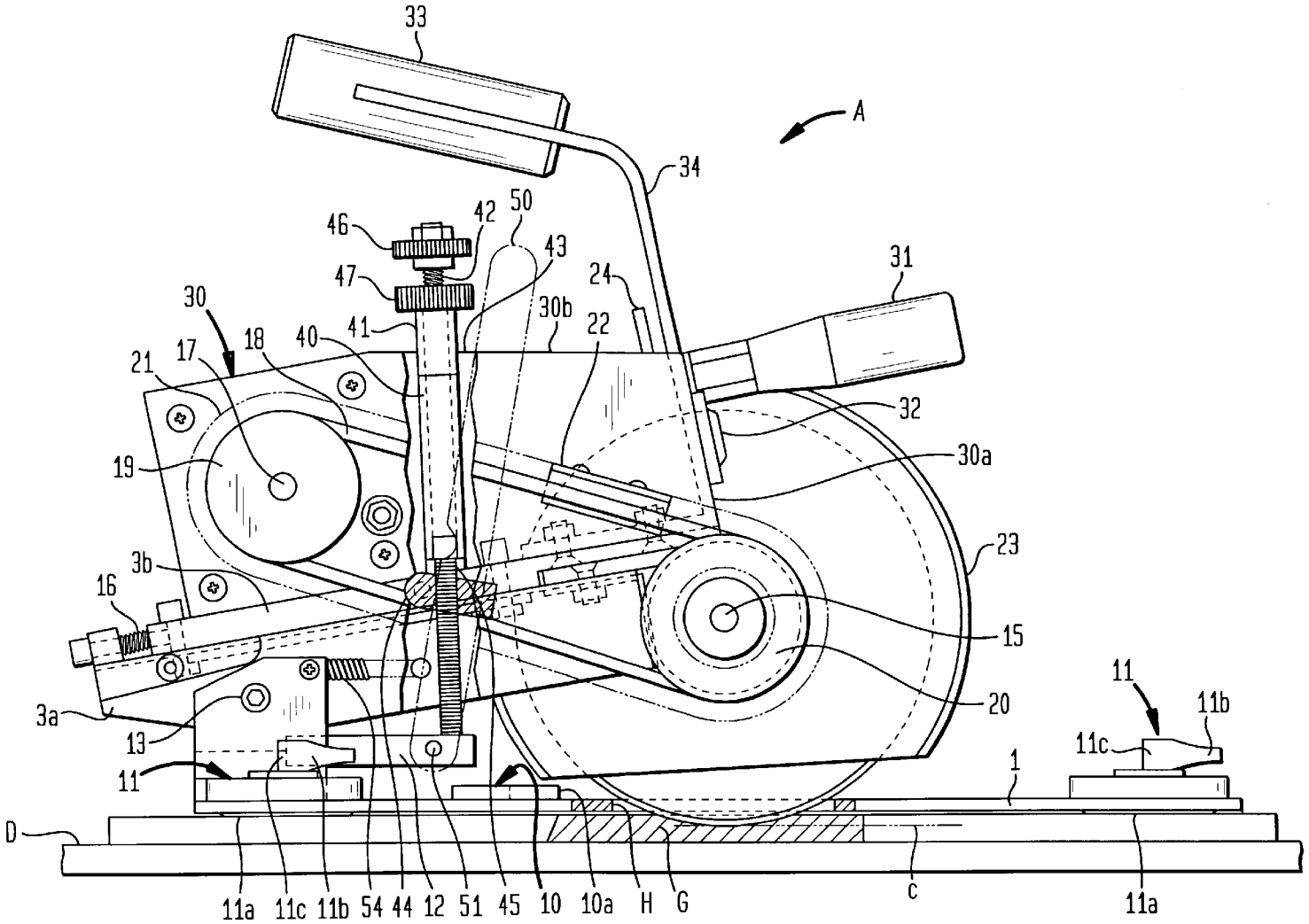
FIG. 8 is a second sectional cut-away lateral view of the glass machining apparatus.
Figure 9:
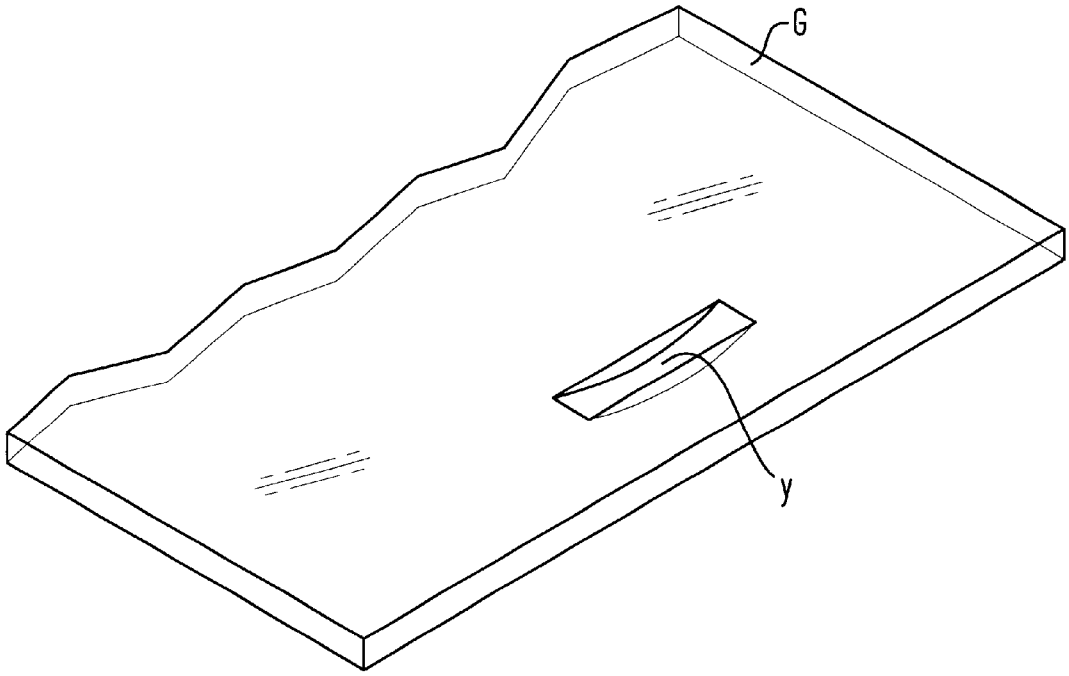
FIG. 9 is an angled view of a section of a glass sheet.

Further, support 3 moves up and down about the pivot support at the center of the base end section, and the position of the lower end section of the glass machining disk 4 is variable from a non-operating position spaced above the base plate 1, as shown in FIG. 1, a first operating position b that is near the upper surface of the base plate 1, as shown in FIG. 7, and a second operating position c that drops below base plate 1 through an operating hole H that is formed in base plate 1, as shown in FIG. 8.

Further, a drop controlling device 6 is mounted on the functional section support 3 for controlling the drop position of the lower end section of the glass machining disk 4, and a non-operating position maintaining device 7 which maintains the lower end section of the glass machining disk 4 in a non-operating position a is disposed between the base plate 1 and the functional section support 3.

The respective constructions of the above-mentioned glass machining apparatus A are further explained as follows.

Base plate 1 is formed in the shape of a rectangular sheet with lathe length running front to back and the operating hole H passes through vertically in the center right side section extending in a front to back direction.

Also, a pivot support 2 is established in the front center section on the base plate 1, a glass sheet positioning unit 10 is established at a position behind pivot support 2, and base plate fixing devices 11, are established on the front and back and left and right sides of the base plate 1.

Figure 3:
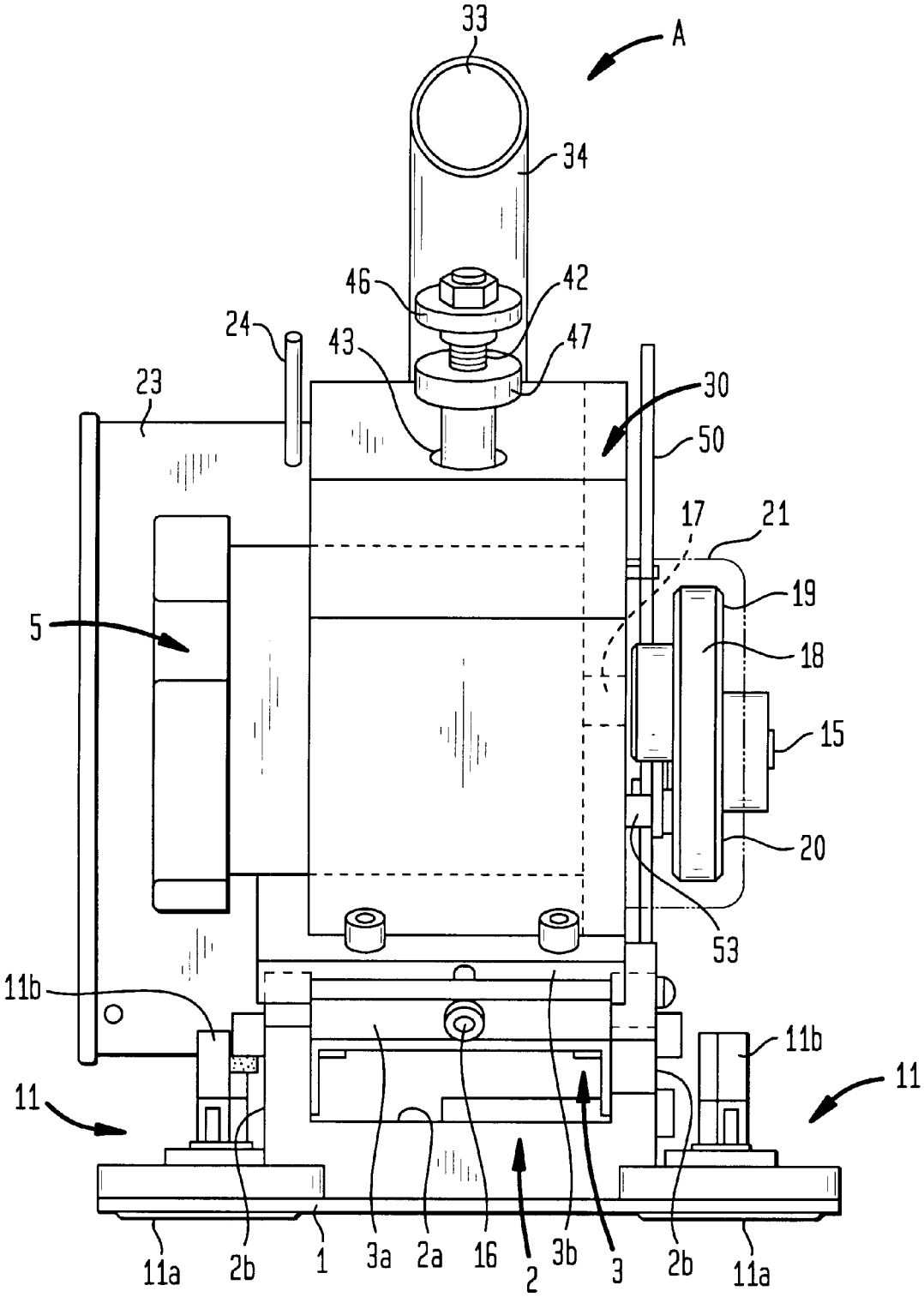
FIG. 3 is a front view of the glass machining apparatus.
Figure 6:
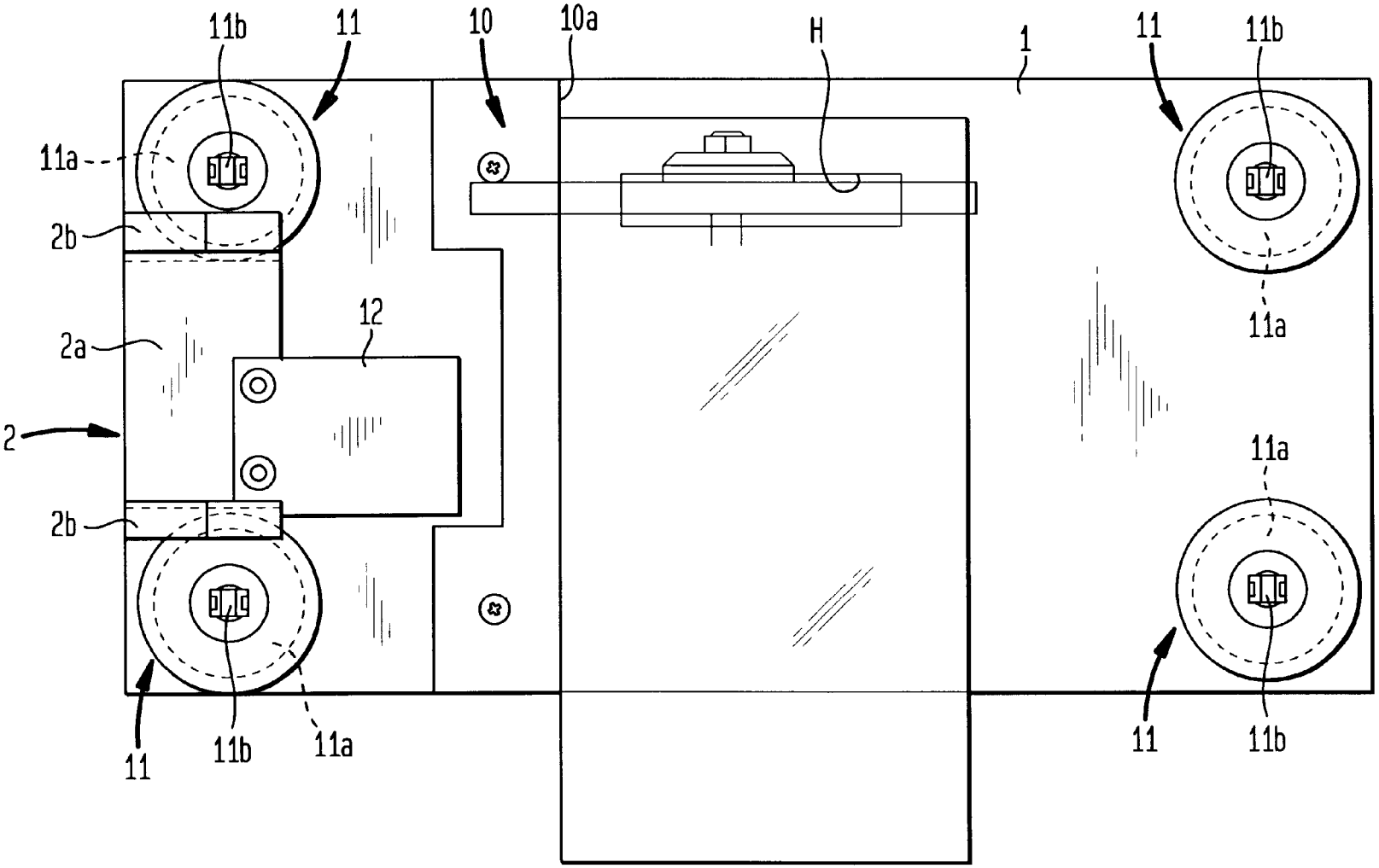
FIG. 6 is an explanatory partial plan view of a base plate.

The pivot support 2 is formed on the front face in an approximate U-shape from the bottom section 2*a* and the left and right sidewall sections 2*b*, as shown in FIGS. 3 and 6 and support plate 12 runs parallel with the base plate 1 in a backward direction at the bottom section 2*a*.

The glass positioning unit 10 runs across from the left side end of the base plate 1 to the right side end as shown in FIG. 6, and includes a straight edge 10*a* which crosses adjacent to the back edge of operating use hole H. The side edge of a glass sheet G abuts the same straight edge 10*a* to establish the position of the glass plate G.

The base plate fixing device 11 is equipped with a suction cup section 11*a* that is disposed on the lower surface wall of base plate 1 and a control section 11*b* that is established as freely rising and dropping to the upper surface wall of base plate 1 with variable control of the attaching surface of the suction cup section 11*a*. As shown in FIGS. 7 and 8, 11*c* is a fulcrum pin for the movement of element 11*b*.

Thus, attachment to the surface of glass sheet G or work stand D is made by the attachment surface of suction section 11*a* and by control section 11*b* which controls movement from the raised state to the lowered state. Compensations for variations in an attachment surface for suction cup section 11*a* are by the control section 11*b* which controls movement from the raised state to the lowered state and release of the attachment to the surface of glass sheet G or work stand D.

Figure 2:
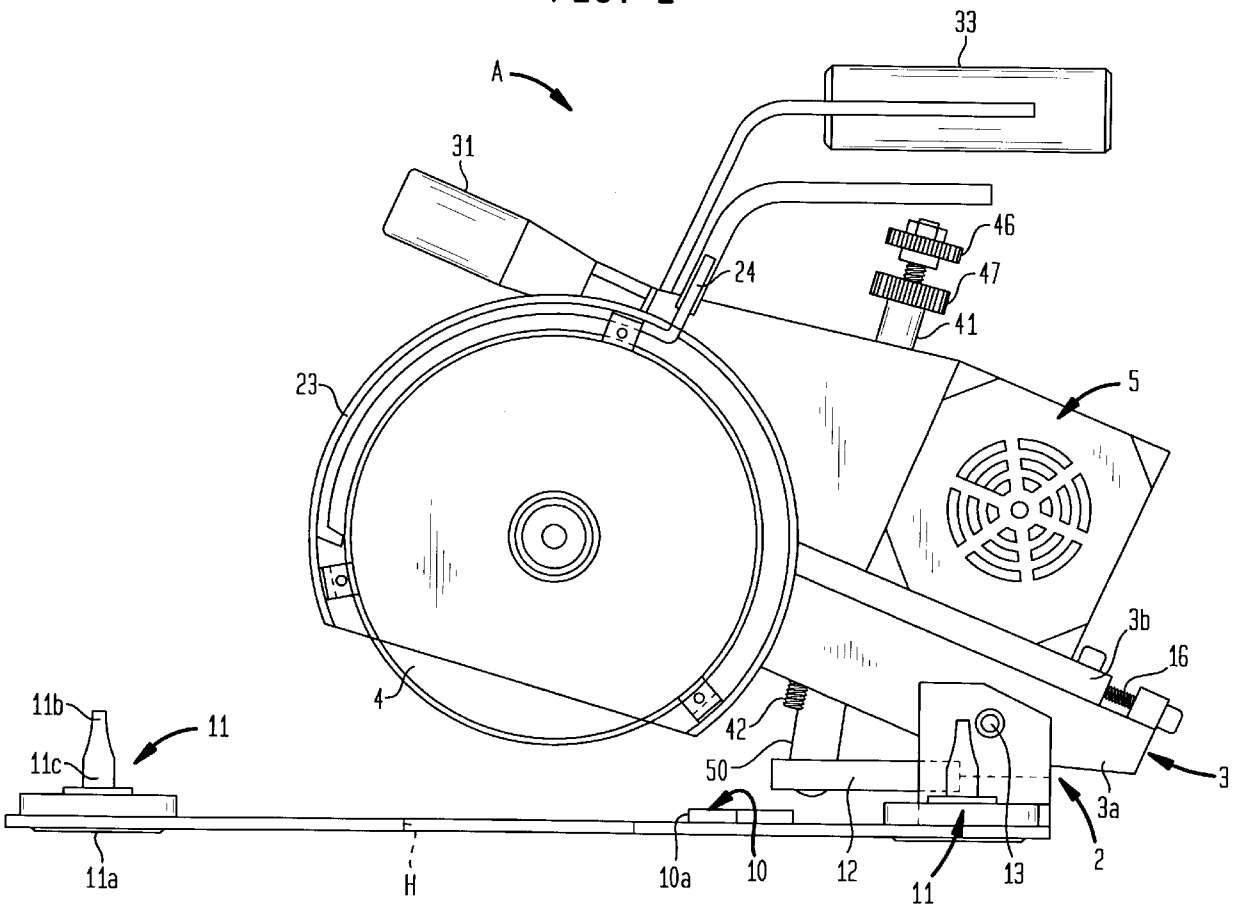
FIG. 2 is a left side view of the glass machining apparatus.
Figure 4:
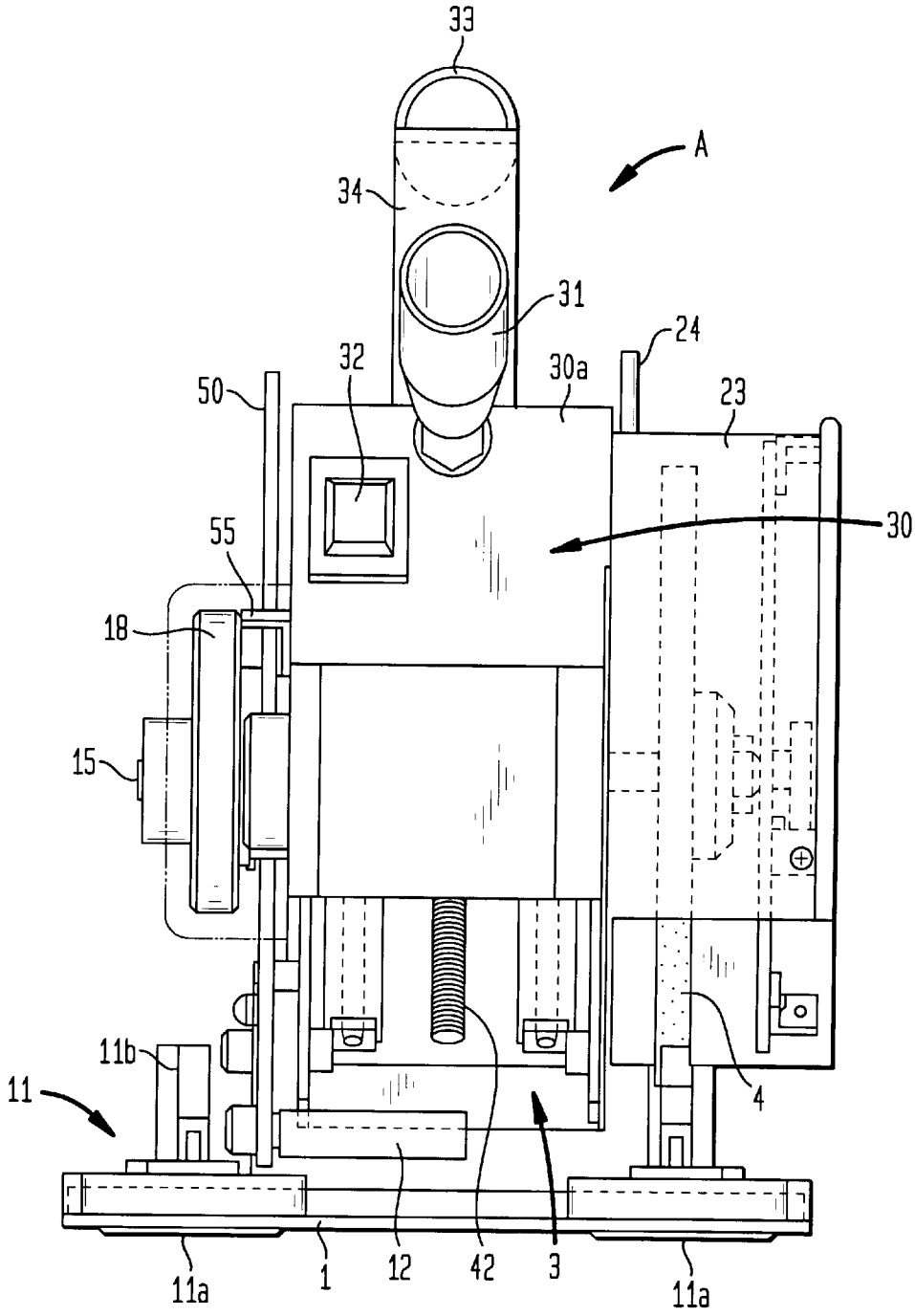
FIG. 4 is a back view of the glass machining apparatus.

As shown in FIGS. 1, 3 and 4, the functional section support 3 runs in the front and back directions and is equipped with a support arm 3*a* that runs crosswise, and a slide support leaf 3*b* that is established with free front-to-back slide position control on the upper surface of the support arm 3*a*. Also, as shown in FIGS. 2 and 8, a front end section of support arm 3*a* pivots about pivot 13 along a crosswise axis and the same support arm 3*a* freely moves up and down in the center with pivot 13 extending between the right and left side wall sections 2*b*, of pivot support 2 shown in FIGS. 3 and 6.

Figure 5:
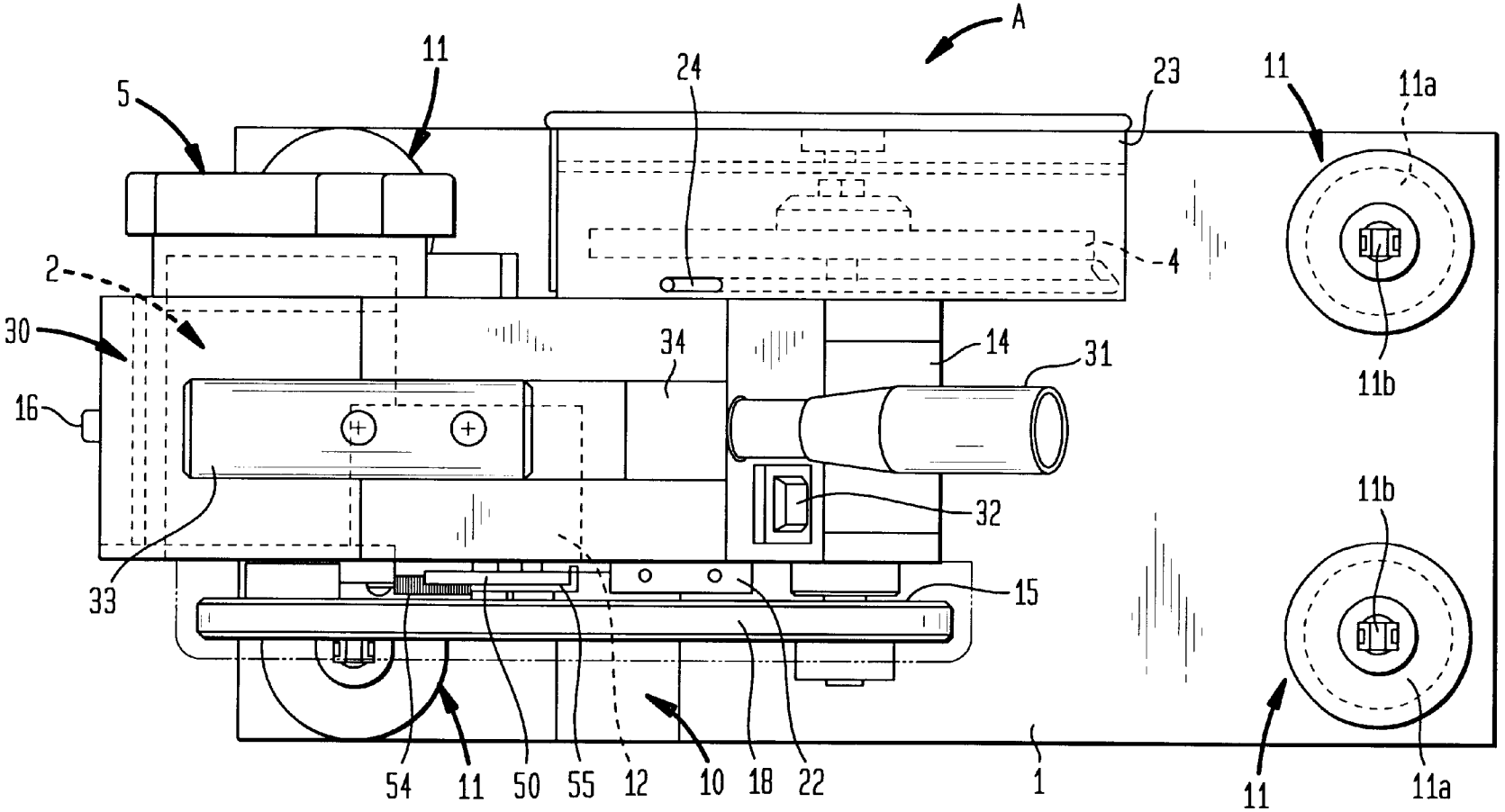
FIG. 5 is a plan view of the glass machining apparatus.

Thus, cylinder shaped bearing 14 shown in FIG. 5, which runs crosswise, is attached to the back end section of the support arm 3*a*. Disk rotational axis 15 extends through in the same direction as bearing 14 and the drive motor 5 is coupled to the left side end section of the same disk rotational axis 15. The center section of the glass plate machining disk 4 is disposed on the right side end section of the disk rotational axis 15. 23 is a disk cover. 24 is a water supply pipe supplying water to the machined surface of glass sheet G.

Further, the slide support leaf 3*b* has a free sliding position control in the front and back directions by slide control bolt 16 that is established on the front end section of support arm 3*a* and drive motor 5 is disposed on the front section of the same slide support leaf 3*b*. Drive axis 17 shown in FIGS. 3, 7 and 8, projects from the same drive motor 5 in the left side direction, belt drive 18 is looped between drive shaft 17 and the disk rotational axis 15 by means of pulleys 19, 20. 21 is a belt drive and 22 is a case attachment bracket.

The center of the drive motor 5 drive shaft 17 and the disk rotational axis 15 is controlled by the slide support leaf 3*b* position control in the front and back directions by a slide control bolt 16 which can make adjustments in the tension of belt drive 18.

Further, a box casing 30 is mounted on the slide support leaf 3*b*, one section of drive motor 5 is covered by the same casing 30, and the up and down movement control handle 31 and the motor control switch 32 are mounted adjacent one another on the back wall 30*a* of the same casing 30.

Thus, the starting and stopping of drive motor 5 by the motor control switch 32 and the control which varies the position of the lower end section of the glass machining disk 4 to the respective operating positions a, b, c shown in FIGS. 1, 7 and 8, by the up and down movement operating handle 31 are easily performed with one hand.

As shown in FIG. 8, a carrying handle 33 is attached by means of handle support 34 to the back end section of the slide support leaf 3*b*. The handle support is projected above the ceiling 30*b* of casing 30 along the back wall 30*a* running in toward the front, and the handle 33 is mounted at the front end section.

Thus, the handle 33 is positioned near an imaginary line perpendicular to the center of gravity position of the entire apparatus and carrying can be easily performed by grasping the handle.

As shown in FIG. 7, the drop control device 6 is equipped with a lower cylindrical female screw 40 that is mounted on the slide support leaf 3*b*, a fixing use female screw 41 that is disposed upward of the cylindrical female screw, and a male screw 42 that is screwed between the female screws 40 and 41. The male screw 42 extends downward through the male screw holes 43, 44, 45 shown in FIGS. 3 and 8, that are formed in the respective upper and lower portions of casing ceiling section 30*b*, the slide support leaf 3*b* and the support arm 3*a*.

Further, the adjustment knob 46 is disposed on the upper end section of the male screw 42 and the fixing control knob 47 is disposed on the upper end section of the fixing female screw 41.

However, the downward movement of the support arm 3*a*, and the lowering of the glass machining disk 4, is controlled by the lower end of the male screw 42 abutting the upper surface of the aforementioned plate 12, as shown in FIGS. 7 and 8.

Thus, after tightening and loosening adjustments for lowering and raising male screw 42 by adjustment knob 46 and further movement of control knob 47 for female screw 41, male screw 42 can be fixed by pressing fixing female screw 41 on male screw 42.

Figure 10:
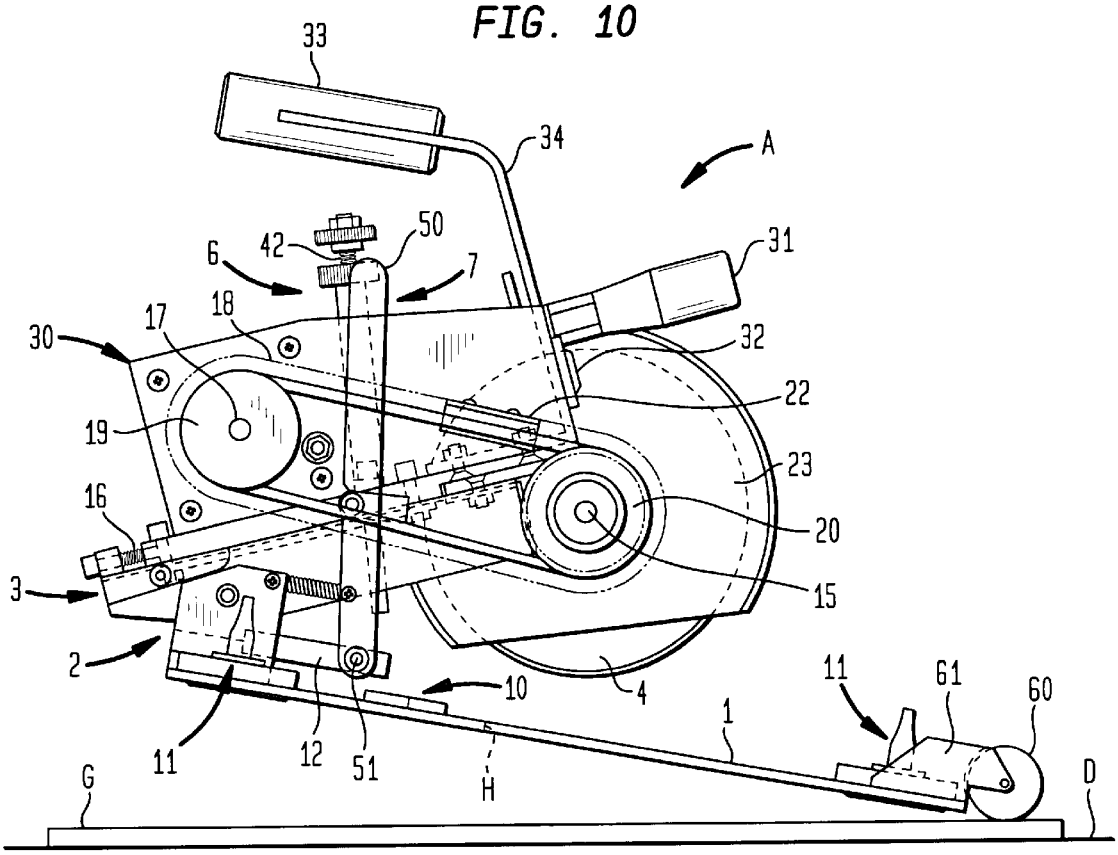
FIG. 10 is a lateral explanatory diagram of another embodiment of a glass machining apparatus.

The respective operating positions b, c of the lower end section of the glass machining disk 4 can be minutely adjusted for the glass machining depth for the respective operating positions b, c by the tightening and loosening adjustment amount of the male screw 42 to improve the machining accuracy. The non-operating position maintaining device 7, as shown in FIGS. 1 and 10, pivots the lower end section of the meshing support arm 50 which extends in the upward and downward direction to the left side end section of plate 12 from a pivot pin 51. A meshing concave section 52 is formed on the middle section of the front side edge of support arm 50.

Also, a meshing pin 53 protrudes to the left wall, outward from the left wall end section of the slide support leaf 3*b*. 54 is a spring that moves and triggers the support arm 50 at the meshing pin 53 side and 55 is a control leaf that controls the backward movement of support arm 50.

Thus, the functional section support 3 is held in position by pin 53 engaging concave section 52 of support arm 50 so that the lower end section of the glass machining disk 4 can be maintained in the non-operating position a.

Figure 11:
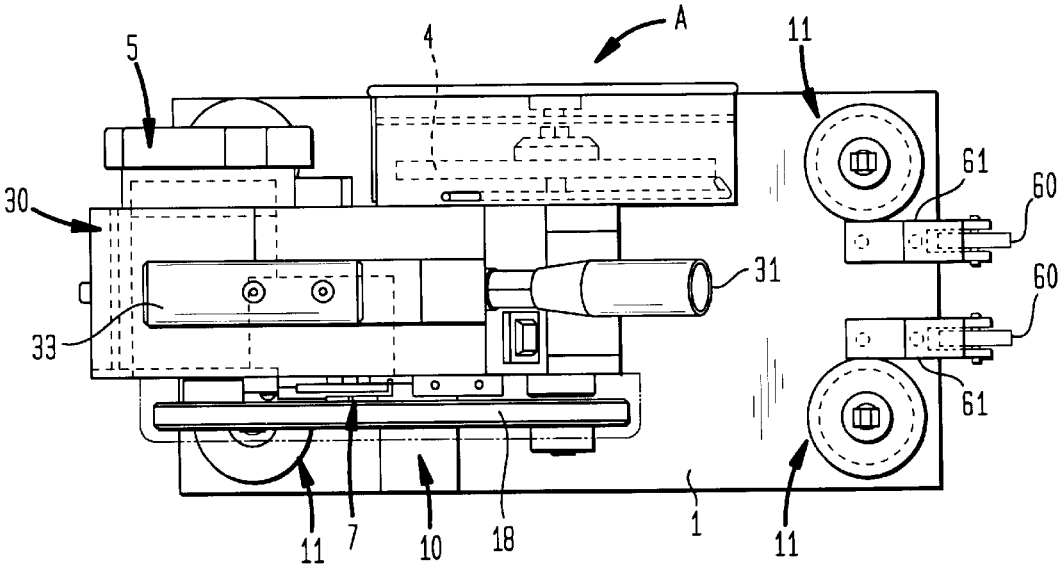
FIG. 11 is another plan view of the glass machining apparatus.

FIGS. 10 and 11 show another example of a glass machining apparatus A. The glass machining apparatus A is the same as the basic construction of the previously described glass machining apparatus but differs at the point of rolling wheels 60 mounted on base plate 1.

That is, along with the addition of a left and right pair of rolling wheels 60 on the back end section of base plate 1 secured by means of wheel supports 61, the rolling wheels 60 provide easy contact on glass sheet G by the base plate 1. The base plate is disposed in a front to back inclined position when the apparatus is held up by grasping the handle 33. The position of handle 33 is established as being in front of an imaginary perpendicular line that passes through the center of gravity of the entire apparatus.

The entire apparatus can be moved easily while both rolling wheels 60 roll on the glass sheet G. The operating efficiency can thus be improved along with reducing the fatigue of the operator who carries out the glass machining operations.

Further, the rolling wheels 60 support utilizes a caster system and the direction of movement of the glass machining apparatus A can be varied smoothly.

Also, the glass machining disk 4 can be used for various applications, and can be positioned at the right side end section with respect to a suitable disk rotational axis 15.

The apparatus includes the following components and functions.

The apparatus includes a base plate forming an operating hole formed therein, a functional section support about which the base end section pivots on the base plate, a glass machining disk that is attached to the front end section of the functional section support and a drive motor that is disposed on the functional section support that drives the glass machining disk. The functional section support moves up and down about a pivot support at the center of the base end section and the position of the lower end of the glass machining disk varies from a non-operating position spaced above the base plate, a first operating position near the upper surface of the base plate, and a second operating position that drops below the base plate into the operating hole that is formed in the base plate.

Thus, when machining a small-scale glass sheet placed on the base plate, the glass sheet can be machined by rotation of the end section of the glass machining disk dropping from a non-operating position to the first operating position.

Further, when machining a large-scale glass sheet, the lower end section of the glass machining disk rotates from the non-operating position to the second operating position through the operating hole.

A large-scale glass sheet is not moved and the machining position and operation can be easily and accurately performed by moving the glass machining apparatus itself.

The apparatus includes a drop position of the lower end section of the glass machining disk on the functional support section.

Thus, the machining depth can be suitably controlled by the drop control device controlling the drop position of the lower end section of the glass machining disk.

The apparatus also includes a non-operating position maintaining device that maintains the lower end section of the glass machining disk in a non-operating position between the base plate and the functional section support.

When glass machining operations are not being performed, the lower end section of the glass machining disk is safely maintained in a non-operating position by the non-operating position maintaining device.

Further, the glass machining operation can then be performed by releasing the glass machining disk from being held by the non-operating position maintaining device.

The apparatus also includes a handle for carrying the-functional section support.

Thus, the glass machining apparatus can be easily carried as well as being able to be raised and lowered easily on a large scale glass sheet by grasping the carrying handle.

Further, the glass machining operations are not limited to use in factories and can be easily performed at smaller job sites.

In addition, the device includes a base plate fixing device on the base plate for securing the base plate on a work stand or a glass sheet.

Thus, the base plate can be secured on a glass sheet by a base plate fixing device along with the glass machining apparatus being positioned on the glass sheet when a large-scale glass sheet is machined. The machining of the glass sheet can he accurately performed by raising and lowering of the glass machining disk between the non-operating position and the second operating position.

In addition, the device is not limited to use on glass sheets. The base plate can be secured to a work stand which can also be used for glass machining.

The use of rolling wheels on one side end section of the base plate, permits movement of the entire apparatus. The wheels are able to move on the glass plate by raising the other side end section of the base plate.

The resultant ease of movement improves the operating efficiency of the glass plate machining apparatus.

What is claimed is:

1. A glass machining apparatus comprising:

a base plate having an operating use hole formed therein, a functional section support mounted on said base plate and having a front end and a base end section and a pivot support at the center of said base end section, said functional support pivoting up and down about said pivot support on said base plate, a glass machining disk attached to the front end of said functional section support, a driving motor disposed on said functional section support, said motor driving said glass machining disk, said glass machining disk having a lower end variable in position between a non-operating position spaced above said base plate and a first operating position adjacent the upper surface of said base plate, and a second lower operating position passing below said base plate through said operating use hole.

2. The glass machining apparatus according to claim 1 including a drop control device for controlling the lower position of the glass machining disk.

3. The glass machining apparatus according to claim 2 including a non-operating position maintaining device maintaining said glass machining disk in said non-operating position.

4. The glass machining apparatus according to claim 3 including a carrying handle secured on said functional support.

5. The glass machining apparatus of claim 3 including a base plate fixing device for securing said base plate on a glass sheet.

6. The glass machining apparatus of claim 5 including rolling wheels attached to one side end section of said base plate, lowering of the other side end section of said base plate causing contact of said wheels with said glass sheet.

7. The glass machining apparatus of claim 3 including a glass plate positioning means extending laterally across said base plate.

* * * * *